US009593556B2

(12) United States Patent
White et al.

(10) Patent No.: US 9,593,556 B2
(45) Date of Patent: Mar. 14, 2017

(54) METHOD AND SYSTEM FOR REDUCING HEAT LOSS FROM SUBSEA STRUCTURES

(75) Inventors: James Eden White, Co Meath (IE); Edmund Peter McHugh, Co Longford (IE)

(73) Assignee: Cameron International Corporation, Houston, TX (US)

( * ) Notice: Subject to any disclaimer, the term of this patent is extended or adjusted under 35 U.S.C. 154(b) by 1890 days.

(21) Appl. No.: 12/673,005

(22) PCT Filed: Sep. 8, 2008

(86) PCT No.: PCT/IB2008/053625

§ 371 (c)(1),
(2), (4) Date: Feb. 10, 2010

(87) PCT Pub. No.: WO2009/044304

PCT Pub. Date: Apr. 9, 2009

(65) Prior Publication Data

US 2011/0159217 A1 Jun. 30, 2011

Related U.S. Application Data

(60) Provisional application No. 60/977,073, filed on Oct. 2, 2007.

(51) Int. Cl.
*B32B 1/02* (2006.01)
*E21B 41/00* (2006.01)
(Continued)

(52) U.S. Cl.
CPC ..... *E21B 41/0007* (2013.01); *E21B 36/003* (2013.01); *Y10T 29/49826* (2015.01); *Y10T 428/13* (2015.01); *Y10T 428/249953* (2015.04)

(58) Field of Classification Search
CPC ..... Y10T 428/13; Y10T 29/49826; Y10T 428/349953; E21B 41/0007; E21B 36/003; B32B 1/08
(Continued)

(56) References Cited

U.S. PATENT DOCUMENTS 3,687,765 A * 8/1972 Maclean ..... 156/187
3,992,237 A * 11/1976 Gerholt et al. ..... 156/86
(Continued)

FOREIGN PATENT DOCUMENTS

GB 2365096 2/2002
SU 1778277 11/1992
(Continued)

OTHER PUBLICATIONS

PCT International Search Report and Written Opinion for PCT/1B2008/053625, dated Feb. 13, 2009.

*Primary Examiner* — Marc A Patterson
(74) *Attorney, Agent, or Firm* — Fletcher Yoder P.C.

(57) ABSTRACT

There is provided a system and method for using a thermal insulating paint in a subsea environment. In accordance with one embodiment of the present technique, the thermal insulating paint may be applied to a casing for use in a subsea mineral extraction system. In another embodiment, a surface-rated thermal insulating paint may be applied to any component for use in a subsea mineral extraction system. The insulated component may be protected from the subsea environment to prevent damage to the surface-rated thermal insulating paint. For example, protecting the component may include burying it in cement or concrete, encasing it in another subsea structure or enclosure, or applying a protective sealant over the surface-rated thermal insulating paint.

3 Claims, 4 Drawing Sheets

(51) Int. Cl.
*E21B 36/00* (2006.01)
*B32B 1/08* (2006.01)

(58) Field of Classification Search
USPC ..... 428/34.1, 34.2, 35.7, 35.9, 36.9
See application file for complete search history.

(56) References Cited

U.S. PATENT DOCUMENTS

| | | | | |
|---|---|---|---|---|
| 4,437,495 | A * | 3/1984 | Zonsveld | 138/144 |
| 5,166,248 | A * | 11/1992 | Kissel | 524/398 |
| 6,155,305 | A | 12/2000 | Sumner | |
| 6,397,895 | B1 * | 6/2002 | Lively | 138/146 |
| 7,144,522 | B2 | 12/2006 | Burchill, Jr. et al. | |

FOREIGN PATENT DOCUMENTS

| | | |
|---|---|---|
| WO | WO0179743 | 10/2001 |
| WO | WO0216519 | 2/2002 |
| WO | WO03004927 | 1/2003 |

* cited by examiner

METHOD AND SYSTEM FOR REDUCING HEAT LOSS FROM SUBSEA STRUCTURES

CROSS REFERENCE TO RELATED APPLICATION

This application claims priority to and benefit of PCT Patent Application No. PCT/IB2008/053625, entitled "Method and System for Reducing Heat Loss from Subsea Structures, "filed Sep. 8, 2008, which is herein incorporated by reference in its entirety, and which claims priority to and benefit of U.S. Provisional Patent Application No. 60/977,073, entitled "Method and System for Reducing Heat Loss from Subsea Structures", filed on Oct. 2, 2007, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity, in addition to myriad other uses. Once a desired resource is discovered below the surface of the earth, drilling and production systems are often employed to access and extract the resource. These systems may be located onshore or offshore depending on the location of a desired resource.

Further, such systems generally include a wellhead assembly through which the resource is extracted. These wellhead assemblies may include a wide variety of components and/or conduits, such as casings, trees, manifolds, and the like, that facilitate drilling and/or extraction operations. For example, casings, such as a production casing, may be utilized to carry the resource from the reservoir to the surface wellhead for production.

In subsea environments, drilling and extraction components may be exposed to relatively low temperatures, for example, in the range of 0-10° C. Resources extracted from beneath the sea floor may be at a much higher temperature, such as, for example, 70° C. The difference in temperatures between the extracted resource and the surrounding seawater may result in rapid heat loss from the extraction component through which the resource is extracted.

For example, a metal casing used to carry oil from the sea floor may experience a temperature gradient of around 60-70° C. Metal may be the most cost-effective material to use in such a corrosive, high-pressure, high-temperature environment, however the metal casing provides little resistance to heat loss. Rapid heat loss through the metal casing may result in the formation of hydrates in the casing. Hydrates are waxy build-ups formed by the combination of water, such as from condensation, and the resource being carried up the casing. Hydrates may plug a pipeline, necessitating a costly and time-consuming unblocking procedure. In addition, extensive hydrate formation may result in the loss of a well, at a great cost.

BRIEF DESCRIPTION OF THE DRAWINGS

Various features, aspects, and advantages of the present invention will become better understood when the following detailed description is read with reference to the accompanying figure, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Figure 1:
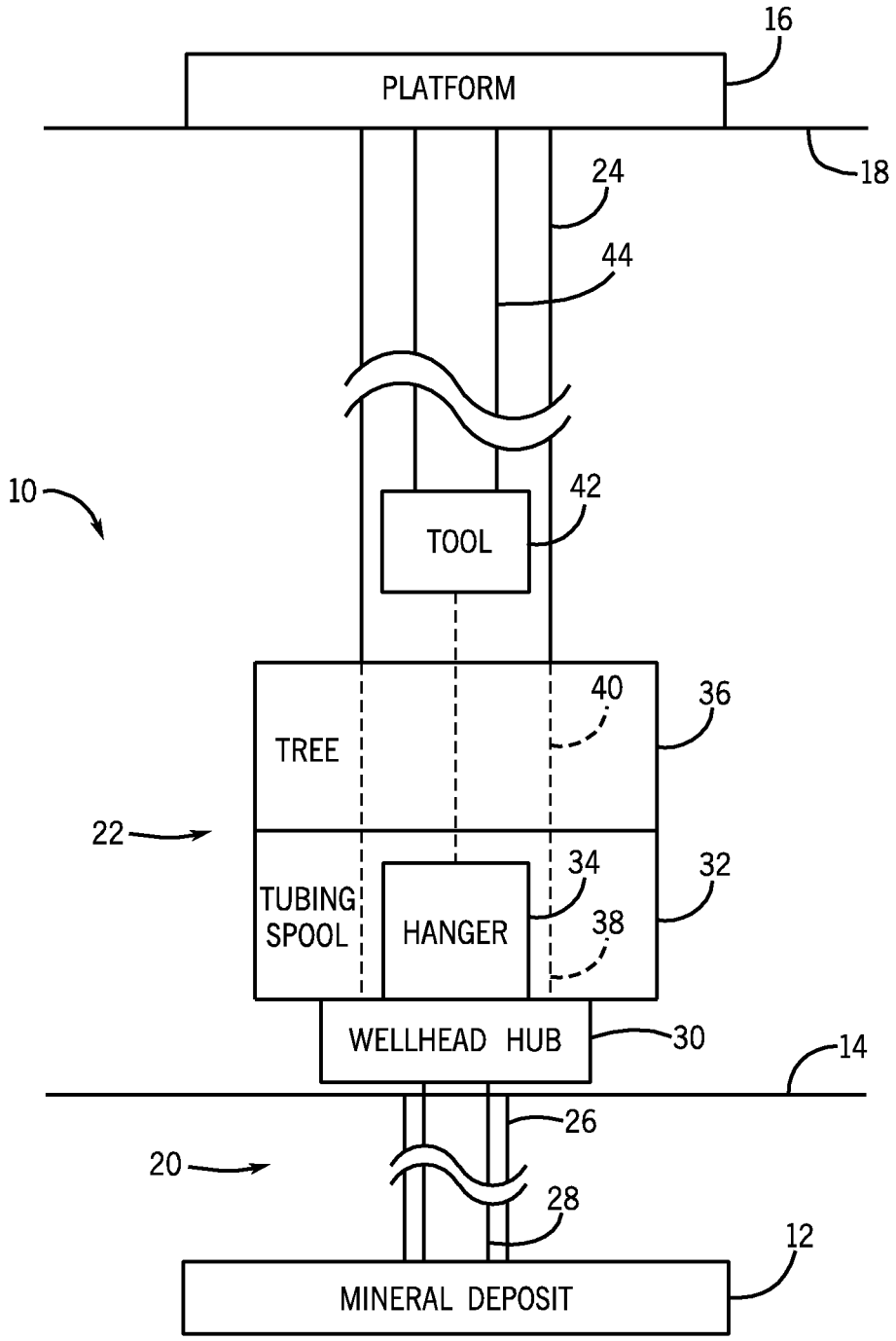
FIG. 1 is a block diagram of a mineral extraction system in accordance with an embodiment of the present invention.

FIG. 1 illustrates an exemplary mineral extraction system 10 having surface-rated insulation (e.g., paint) disposed on various subsurface components (e.g., in the sea or subsea). In one embodiment, the insulation may be a paint not intended, designed, or capable of enduring the harsh environment in seawater, below the sea, and/or exposure to mineral deposits. However, the components may be insulated with the surface-rated insulating paint and then subsequently sealed off from the surrounding environment (e.g., seawater) as discussed below. The system 10 may be configured to extract minerals, such as oil and gas, from a mineral deposit 12 beneath a sea floor 14, and to carry the minerals to a platform or other production vessel 16 at sea level 18. The illustrated mineral extraction system 10 generally includes a well 20, a wellhead 22, and a casing 24.

The well 20 may include the mineral deposit 12 and a borehole 26. A conductor 28 may be disposed within the borehole 26 to extract minerals from the mineral deposit 12 and to inject chemicals into the deposit 12. For example, chemicals may be injected into the mineral deposit 12 to improve mineral recovery. The conductor 28 may encase various casings and tubings to facilitate transfer of different fluids in and out of the well 20. For example, within the conductor 28 there may be disposed one or more concentric casings and a production tube. In addition, the conductor 28 may be buried in cement or concrete to secure it within the borehole 26. Minerals from the mineral deposit 12 below the sea floor 14 may be very hot, while the temperature of the seawater above the sea floor 14 is relatively very cold. Minerals traveling up through the production tube in the conductor 28 may experience a large drop in temperature near the sea floor 14, resulting in a waxy build-up known as hydrates. Hydrates may be reduced or prevented by insulating the conductor 28, the casings, and/or the production tube, as described in more detail below.

The wellhead 22 may generally include a wellhead hub 30, a tubing spool 32, a hanger 34, and what is colloquially referred to as a "christmas tree" 36 (hereinafter a tree). The wellhead hub 30 may include a large diameter hub that is disposed near the termination of the borehole 26 at the sea floor 14. Thus, the wellhead hub 30 may provide for the connection of the wellhead 22 to the well 20. In one embodiment, the wellhead hub 30 includes a Deep Water High Capacity (DWHC) hub manufactured by Cameron of Houston, Tex. The wellhead hub 30 may couple the conductor 28 to the wellhead 22.

The tubing spool 32 may provide an intermediate connection between the tree 36 and the wellhead hub 30 and may also support the hanger 34. The tubing spool 32 may be secured to the wellhead hub 30 prior to installation of the tree 36. A tubing spool bore 38 may enable fluid communication between a tree bore 40 and the well 20. Further, the hanger 34 may be secured within the tubing spool bore 38. The hanger 34 may secure the conductor 28, tubing, and casing suspended in the borehole 26. The hanger 34 generally provides a path for hydraulic control fluid, chemical injections, or the like to be passed through the wellhead 22 and into the borehole 26.

The tree 36 may route the flow of extracted minerals from the well 20, regulate pressure in the well 20, and inject chemicals down hole into the borehole 26, for example, via a variety of flow paths (e.g., bores), valves, fittings, and controls for operating the well 20. Further, the tree 36 may provide fluid communication with the well 20. For example, the tree bore 40 may enable completion and workover procedures, such as the insertion of tools (e.g., the hanger 34) into the wellhead 22, the injection of various chemicals into the well 20, and the like. Further, minerals extracted from the well 20 (e.g., oil and natural gas) may be regulated and routed via the tree 36. For instance, the tree 36 may be coupled to the casing 24, a jumper, or a flowline, and tied back to other components, such as a manifold on the platform 16. Accordingly, extracted minerals flow from the well 20 to the platform 16 via the wellhead 22 before being routed to shipping or storage facilities.

Other devices may also be coupled to the wellhead 22 or used to assemble and control various components of the wellhead 22. For example, in the illustrated embodiment, the system 10 includes a tool 42 suspended from a drill string 44. In some embodiments, the tool 42 may include a running tool that is lowered (e.g., run) from the platform 16 to the well 20 or to the wellhead 22 to assemble various components of the system 10. The tool 42 may be run to the wellhead 22 within the casing 24. The casing 24 may also include other casings and tubings to carry various fluids, such as hydraulic fluids, injection chemicals, and extracted minerals to and from the platform 16. As with the tubing, casings, and conductor 28 in the well 20, the casing 24 may be insulated using thermal insulation paint, as described in more detail below.

Figure 2:
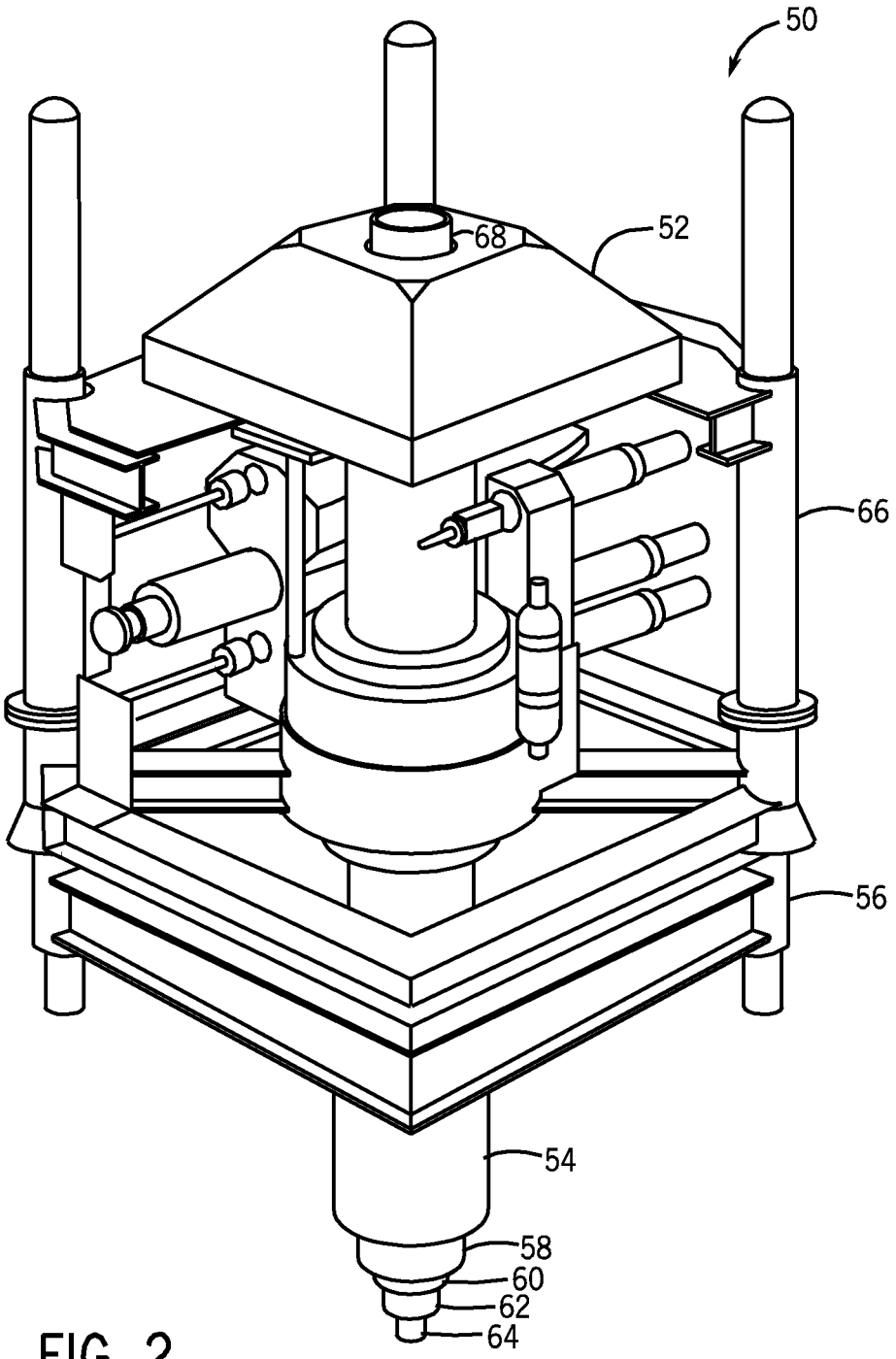
FIG. 2 is a perspective view of a subsea well assembly in accordance with an embodiment of the present invention.

FIG. 2 illustrates an exemplary subsea mineral extraction system 50. The system 50 includes a wellhead 52, a conductor 54, and a base 56. Casings 58, 60, and 62 are disposed concentrically within the conductor 54. A tubing 64 is disposed within the casing 62. The tubing 64 may be used to transport the extracted minerals from the mineral reservoir 12 (FIG. 2) to the wellhead 52. The casings 58, 60, and 62 may contain various production equipment and fluids, such as, for example, a blowout preventer, drilling mud, injection chemicals, and the like. The base 56 may be situated on or near the sea floor 14 and may facilitate connection of the conductor 54 to the wellhead 52. The wellhead 52 may be coupled to the base 56 via a frame 66. A casing 68 may be utilized to transport the extracted minerals from the wellhead 52 to a platform or other production vessel at sea level. The casing 68 may contain additional casings for carrying various fluids to and from the surface.

In accordance with an embodiment of the present invention, casings may be insulated with a thermal insulating paint. A thin layer of the thermal insulating paint may provide insulation equivalent to several inches of traditional insulation. For instance, less than a millimeter of thermal insulating paint may provide insulation comparable to six inches of foam insulation.

In another embodiment, components that are buried below the sea floor 14, encased in cement, or otherwise sealed from the subsea environment may be insulated with a surface-rated thermal insulating paint. The surface-rated thermal insulating paint may be a resin containing highly porous particles obtained by drying a wet sol-gel, such as Nansulate®, available from Industrial Nanotech, Inc., of Naples, Fla. As described above in FIG. 1, the conductor 54 may be at least partially buried under the sea floor 14. That is, the conductor 54 may be disposed within the borehole 26. To ensure that the conductor 54 remains in place, cement or concrete may be placed around the conductor 54 within the borehole 26. In addition, other components may be partially or completely buried in cement or concrete. For example, the base 56 may be at least partially encased in cement. Other components may include casings, piles, and other equipment situated at or near the sea floor. In addition, some casings and tubings may be protected from the subsea environment by being encased in other casings.

The cement, concrete, or outer casing may constitute a protective structure within which a surface environment may be approximated. That is, the protective structure may seal the surface-rated thermal insulating paint from the subsea environment which would otherwise damage the paint. For example, the paint may be applied and then sealed off from the seawater, chemicals, oil and gas, and other harsh substances that may break down or reduce the effectiveness of the paint. The sealing may be provided by concrete, cement, casings, housings, or other subsurface sealants (e.g., paints). Other subsurface sealants may include, for example, a sealant or paint that is rated for a subsea or corrosive environment. The subsurface sealant may be insulative or merely resistant to the surrounding environment, such as, for example, seawater, chemicals, oil, gas, etc. In addition, different sealants may be utilized depending on the location of the surface-rated thermal insulating paint and the environment. That is, one sealant may be resistant to seawater and may be applied to an external component, while another may be resistant to chemicals or oil and gas and may be applied to a component disposed within the system. This technique may also be applied as a cost-reducing measure where a more expensive subsea-rated thermal insulating paint is available. That is, one or more layers of the surface-rated thermal insulating paint may be applied to a component, then the subsea-rated thermal insulating paint may be applied over the surface-rated paint to protect the system from the subsea environment. Accordingly, the surface-rated thermal insulating paint may be utilized in a location where its use would otherwise be precluded.

Traditional insulating techniques are not generally useful in this application as molded insulation, such as foam, polymer, and resin, cannot, for example, support the load of the surrounding casings 58, 60, and/or 62. In addition, traditional insulation may permit moisture to accumulate between the insulation and the object being insulated. This accumulation of moisture may lead to corrosion of the insulated object. By applying one or more layers of thermal insulating paint to the object, moisture does not accumulate on the surface of the object. In addition, the thermal insulating paint may provide a very thin insulative coating as compared to other types of insulation. The thermal insulating paint may have a thickness of less than 50 mils, 40 mils, 30 mils, 20 mils, or even 10 mils. For example, in some embodiments, the thermal insulating paint may have a thickness of about 4.5-7.5 mils. This coating may provide as much insulation as several inches of traditional insulation, while still withstanding the pressures associated with subsea use.

Figure 3:
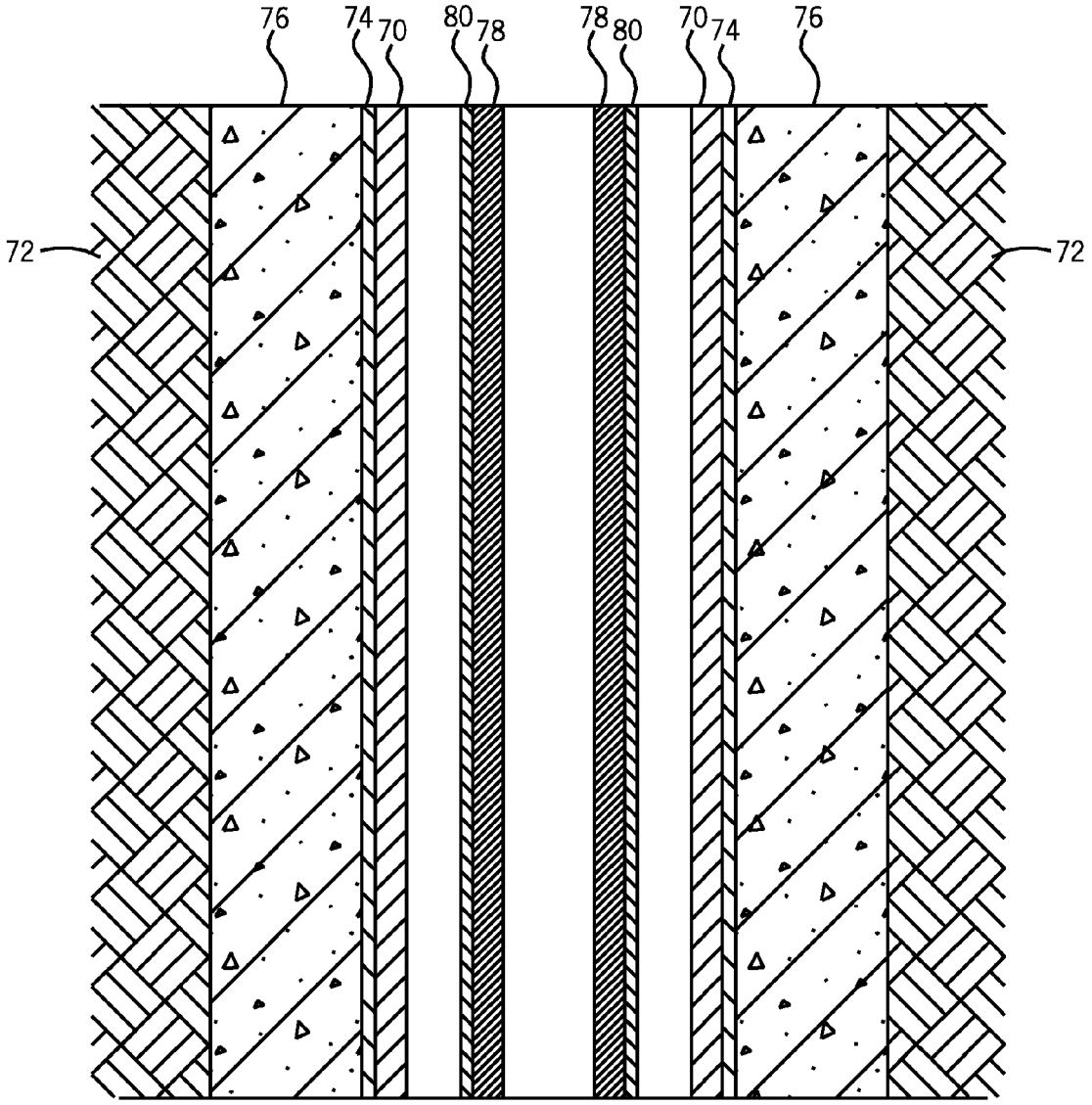
FIG. 3 is a section view of a portion of a subsea well assembly in accordance with an embodiment of the present invention.

FIG. 3 illustrates a section of buried subsea mineral extraction components in accordance with an embodiment of the present invention. A conductor 70 is buried in a sea floor 72. The conductor 70 is coated with one or more layers 74 of surface-rated thermal insulating paint and surrounded by cement 76. Within the conductor 70, a casing 78 is also coated with one or more layers 80 of surface-rated thermal insulating paint. The paint layer 74 is protected from the subsea environment by the cement 76, and the paint layer 80 is protected from the subsea environment by the conductor 70. The surface-rated thermal insulating paint may therefore be used to insulate the casing 78 and the conductor 70 to reduce the possibility of hydrates forming in the system.

Figure 4:
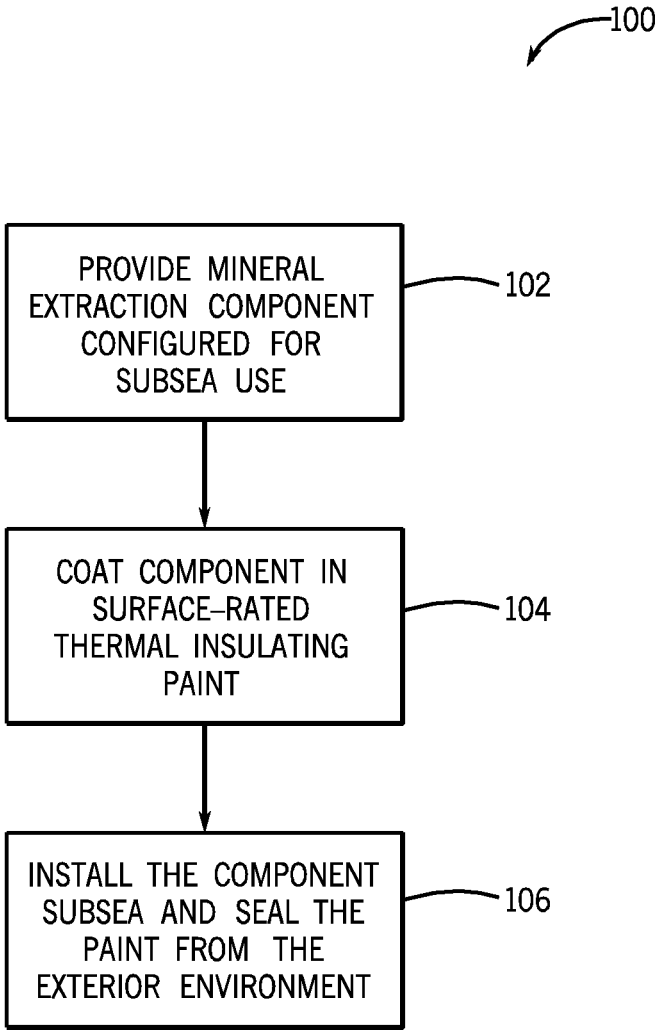
FIG. 4 is a flow chart of a process for manufacturing and using a subsea well assembly in accordance with an embodiment of the present invention.

FIG. 4 illustrates a flow chart of an exemplary process 100 for insulating a subsea mineral extraction component. A mineral extraction component may be provided for use in a subsea environment (block 102). The component may be at least partially or entirely coated in a surface-rated thermal insulating paint (block 104). That is, a portion or all of the component may be covered in the paint. The portion may include, for example, an interior and/or an exterior of a casing. In addition, the portion may include a length of the casing which will be buried in the sea floor. Coating the component in the surface-rated thermal insulating paint may include applying multiple layers of the surface-rated thermal insulating paint. For example, three layers of paint may be applied to the component, with each layer drying for a time before the next layer is applied. Each layer may be applied at a thickness of approximately 3-5 mils, which results in a dry layer of 1.5-2.5 mils thickness.

Once the surface-rated thermal insulating paint has been applied to the subsea mineral extraction component, the coated component may be installed subsea such that the surface-rated thermal insulating paint is sealed off from the subsea environment (block 106). For example, the coated component may be buried in cement or concrete. The coated component may also be sealed within a casing or other subsea component. Further, the component may be internally coated such that the surface-rated thermal insulating paint is not exposed to the external environment. It may also be desirable to seal the insulating paint from other environments for which it is not rated. That is, production and extraction fluids such as oil, gas, injection chemicals, etc. may also damage the surface-rated thermal paint, therefore the insulative coating may be further sealed off from such environments. For example, the paint may be applied only to portions of components that will not be exposed to such environments.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a component of a subsea system configured to extract oil or gas from a reservoir;

a surface-rated insulative paint disposed on the component, wherein the surface-rated insulative paint is susceptible to break down or reduce effectiveness in a subsea environment or a corrosive environment; and a protective structure to protect the surface-rated insulative paint from the subsea environment or the corrosive environment, wherein the protective structure is resistant to the subsea environment or the corrosive environment.

2. The system of claim 1, wherein the surface-rated insulative paint is susceptible to seawater in the subsea environment of the subsea system, and the protective structure blocks seawater from contacting the surface-rated insulative paint.

3. The system of claim 1, wherein the surface-rated insulative paint is susceptible to oil, gas, or chemicals in the corrosive environment of the subsea system, and the protective structure blocks the oil, gas, or chemicals from contacting the surface-rated insulative paint.

* * * * *